United States Patent [19]

Albrecht et al.

[11] 4,405,284

[45] Sep. 20, 1983

[54] CASING FOR A THERMAL TURBOMACHINE HAVING A HEAT-INSULATING LINER

[75] Inventors: Günter Albrecht, Feldgeding; Albert Sickinger, Munich; Hans-Jürgen Schmuhl, Wörthsee, all of Fed. Rep. of Germany

[73] Assignee: MTU Motoren-Und-Turbinen-Union Munchen GmbH, Munich, Fed. Rep. of Germany

[21] Appl. No.: 263,447

[22] Filed: May 14, 1981

[30] Foreign Application Priority Data

May 16, 1980 [DE] Fed. Rep. of Germany ..... 3018620

[51] Int. Cl.[3] ..... B05D 1/08

[52] U.S. Cl. ..... 415/174; 427/34; 427/423

[58] Field of Search ..... 427/34, 423; 415/174; 277/53

[56] References Cited

U.S. PATENT DOCUMENTS

| | | | |
|---|---|---|---|
| 3,068,016 | 12/1962 | Dega | 415/174 |
| 3,545,944 | 12/1970 | Emanuelson et al. | 415/174 |
| 4,055,705 | 10/1977 | Stecura et al. | 427/34 |
| 4,248,940 | 2/1981 | Goward et al. | 427/34 |
| 4,273,824 | 6/1981 | McComas et al. | 427/34 |
| 4,289,446 | 9/1981 | Wallace | 415/174 |

*Primary Examiner*—John H. Newsome

*Attorney, Agent, or Firm*—Alan H. Levine

[57] ABSTRACT

A thermal turbomachine casing having a multilayer heat insulation liner including a metallic bond coat in direct contact with the casing wall, a ceramic heat insulation layer bonded to the bond coat, and preferably an abradable coating in the form of a porous, predominantly metallic, top layer bonded to the ceramic layer. A metallic honeycomb may be fixed to the casing wall, in which case the bond coat, ceramic layer, and top layer are within the cells of the honeycomb. The bond coat and ceramic layer may partially or completely fill the honeycomb cells. The layers may be deposited by flame or plasma spraying, preferably after peening the casing wall. Each succeeding layer is deposited before any cooling of the preceeding layer.

14 Claims, 3 Drawing Figures

CASING FOR A THERMAL TURBOMACHINE HAVING A HEAT-INSULATING LINER

This invention relates to a casing for a thermal turbomachine having a heat insulation liner of a ceramic material, and coordinately to a method of making such a casing.

The increasingly stiff requirements that have recently been specified for thermal turbomachines, such as gas turbines and compressors, create problems with the thermal insulation of such machines. A ceramic liner for such casings has afforded considerably improvement, although attempts so far to resolve the problem of unlike thermal expansions between the metal casing and the ceramic liner, at reasonable expense, have met with little success. Another problem posed by casings lined with ceramic materials is that ceramics, because of their significant hardness, make poor abradable coatings for highspeed rotors, and therefore they aggravate the wear on the rotors, causing imbalance and excessive clearances.

It is a broad object of the present invention to provide a casing for a thermal turbomachine having a ceramic heat insulation liner such that it affords excellent heat insulation plus optimal abradable capacity. The casing additionally offers a maximum of resistance to temperature and to temperature alterations. It is a particular object of the present invention to provide such a casing having a multilayer liner including a metallic bond coat contacting the casing wall, a ceramic intermediate layer, and a porous predominantly metallic top layer forming an abradable coating.

A casing liner formed in accordance with the present invention provides an advantage in that it furnishes heat insulation between the hot gas stream and the metallic casing, owing to the intervening ceramic layer, and at the same time, the porous, predominantly metallic, top layer minimizes the wear the rotor suffers by rubbing against the casing. It is especially in transient operating modes of the turbomachine that a multiple-layer compound body improves the operational behavior. As an example, when the turbomachine is accelerated and the temperature rises accordingly, the heat-insulating intermediate ceramic layer prevents rapid and pronounced expansion of the thin-walled metal casing to minimize the clearance which developes between the slowly expanding rotor and the casing. When the turbomachine is decelerated, on the other hand, and when the temperature drops accordingly in the interior, the thin-section casing can be prevented from cooling much more rapidly than the rotor and so causing unduly severe wear on the inner surface of the casing by the rotor, especially in the event of re-acceleration in the deceleration phase. Should the rotor begin to rub, wear on the rotor or on the rotor blades is reduced by the particular condition of the inner top layer of the casing liner. In sum, the liner designed for a casing in accordance with the present invention permits the clearance between the rotor or rotor blades and the casing to be kept narrow to improve current efficiencies.

It is a further object of the present invention to provide such a casing including a metallic honeycomb partially or completely filled with a metallic bond coat and a ceramic heat insulation layer. Filling the metallic honeycomb materials conventionally used as abradable coatings with a heat-insulating layer will here again provide the benefits just described in the transient operating mode of the turbomachine.

According to a preferred feature of the present invention, a porous, predominantly metallic, top layer of a material suitable for providing an abradable coating is also applied to the honeycomb material until flush with its face. The complete filling of the honeycomb structure serves to provide improved protection from hot gas corrosion of the metallic honeycomb material proper and additional improvement of the heat insulation effect.

According to another preferred feature of the present invention, which particularly benefits gas turbine casings, the porous top layer consists of a hot gas corrosion resistant material, especially of a metal-chromium-aluminum-yttrium alloy, which gives the honeycomb material sufficient protection from hot gas corrosion even in the most elevated temperature ranges. The present invention also relates to a method for manufacturing a casing liner wherein the liner is applied to the casing wall by thermal spraying, preferably after the wall is first peened. The method of the present invention serves to effect bonding between the various layers, by mechanical gripping and physical bonding, diffusion, and metallurgical interaction, in the interest of especially firm adhesion. The method of the present invention ensures a high interface temperature and good wetting, which is a prerequisite to the firm adhesion of the various layers one to the other. It has been shown that roughness heights of 30 to 40 μm make for especially good gripping between the metal casing and the bond coat (snap fastener principle).

An illustrative embodiment of a casing in accordance with the present invention for a thermal turbomachine is illustrated in the accompanying drawings, in which.

Figure 1:
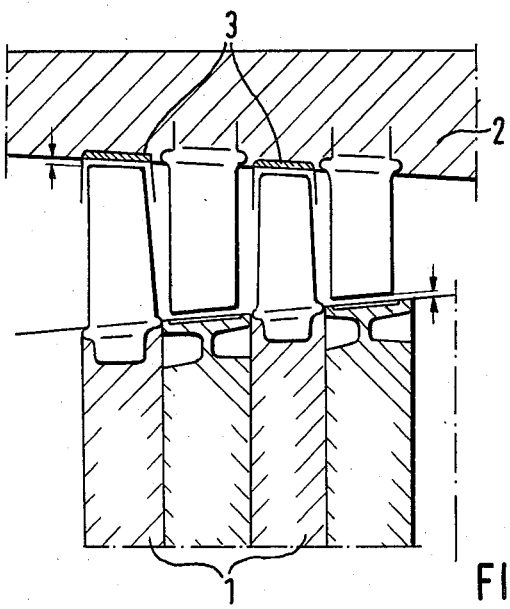
FIG. 1 is a fragmentary longitudinal cross-sectional view of a turbomachine.

In the longitudinal cross-section of FIG. 1, a rotor 1 of a turbomachine rotates within a casing 2. The rotor 1 comprises two rotor discs each fitted with axial-flow rotor blades. Arranged opposite the face of each rotor blade, the casing 2 is provided with a multiple-layer liner 3 formed in accordance with the present invention.

Figure 2:
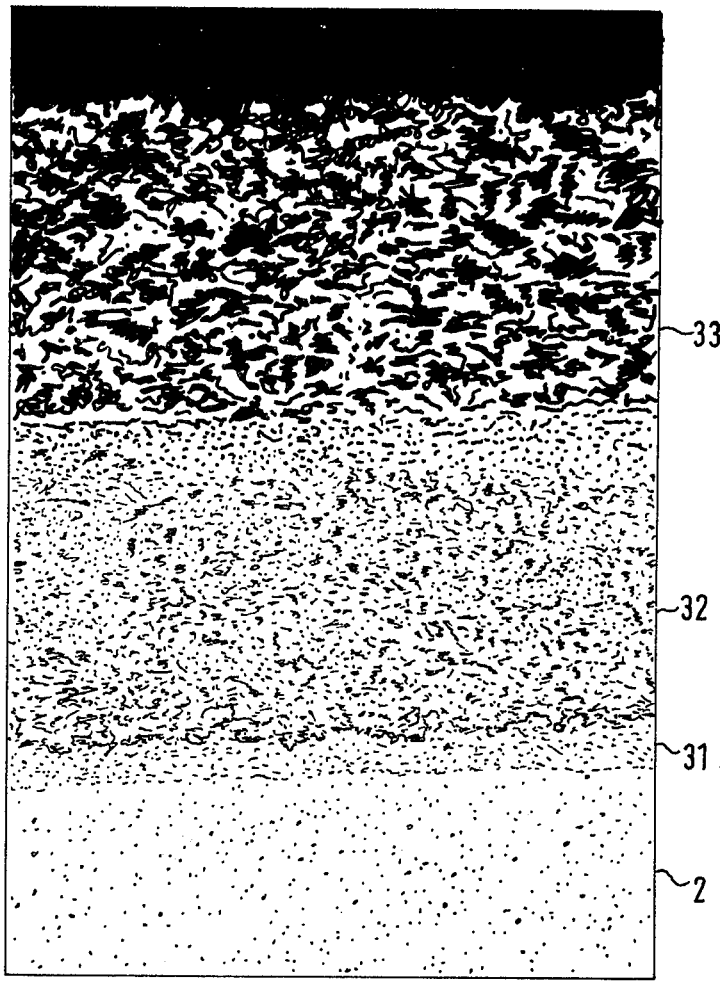
FIG. 2 is a ground and polished microsection of a casing liner in accordance with the present invention, at about 50X magnification.

The structural arrangement of liner 3 will be apparent from the enlarged view of a microsection. As shown in FIG. 2, arranged directly over the surface of the metallic casing 2 is a metallic bond coat 31, over which is a ceramic intermediate layer 32, covered in turn by a porous, predominantly metallic, top layer 33. The white spaces in the top layer 33 are nickel constituents, the dark grey spaces are graphite constituents, and the black spaces are cavities. The black rim appearing above the top layer 33 is a background, i.e., it does not form part of the top layer 33.

Figure 3:
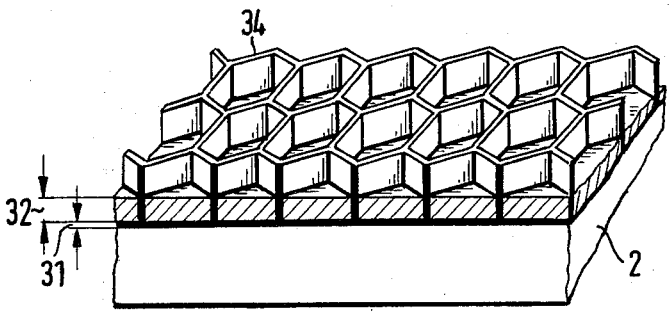
FIG. 3 is a fragmentary perspective view of a casing liner incorporating a honeycomb structure.

In the perspective view of FIG. 3, the metallic casing wall 2 carries a bond coat 31. Unlike in the liner of FIG. 2, however, a metallic honeycomb material 34 is brazed on to the metallic casing wall 2. Preferably, the width of each honeycomb cell is a minimum of 2 mm. Filling the honeycomb cells by flame or plasma spraying is the bond coat 31 and, thereon, the ceramic insulation layer 32. In the embodiment of FIG. 3, the honeycomb cells 34 are filled to only about one-half of their depth, and empty space remains above the ceramic insulation layer 32.

In an alternative embodiment, the empty space above the ceramic insulation layers 32 in the honeycomb cells 34 can be filled with a porous, predominantly metallic, top layer or with a hot gas-corrosion-resistant top layer. The use of the honeycomb material 34 is advantageous since it provides a support for the multiple-layer compound liner consisting of the bond coat 31, the heat insulation layer 32, and where desirable, the porous top layer 33. In another alternative embodiment, the honeycomb cells are completely filled with the bond coat 31 and insulation layer 32.

The metallic bond coat may comprise a Ni-Cr-Al alloy including 4.5 to 7.5%, by weight, aluminum, 15.5 to 21.5%, by weight, chromium, the remainder being nickel. The ceramic heat insulation layer may comprise $ZrO_2$ stabilized with a material selected from the group consisting of 5 to 31% CaO, 8 to 20% $Y_2O_3$, and 15 to 30% MgO. A metallic component may be admixed with the stabilized $ZrO_2$. The top layer may be selected from the group consisting of Ni-Cr alloy, Ni-BN metal ceramic compound, Ni-polyamid metal-plastic compound, and Ni-graphite compound. The casing wall may be peened, using $Al_2O_3$, prior to depositing the bond coat on it.

The invention has been shown and described in preferred form only, and by way of example, and many variations may be made in the invention which will still be comprised within its spirit. It is understood, therefore, that the invention is not limited to any specific form or embodiment except insoar as such limitations are included in the appended claims.

We claim:

1. A casing for a thermal turbomachine having a heat insulation liner, characterized by the liner being a multilayer formation comprising:

a metallic bond coat in direct contact with the casing wall, a ceramic heat insulation layer bonded to the bond coat, and an abradable coating in the form of a porous, predominantly metallic, top layer bonded to the ceramic layer.

2. A casing as defined in claim 1 including a metallic honeycomb fixed to the casing, the metallic bond coat and ceramic layer partially filling the honeycomb cells.

3. A casing as defined in claim 2 wherein the abradable coating fills the remaining portion of the honeycomb cells until flush with the exposed face of the honeycomb.

4. A casing as defined in claim 3 wherein the porous, predominantly metallic, material is a metal-chromium-aluminium-yttrium alloy.

5. A casing as defined in claim 1 wherein the metallic bond coat comprises a Ni-Cr-Al alloy including 4.5 to 7.5%, by weight, aluminium, 15.5 to 21.5%, by weight, chromium, the remainder being nickel.

6. A casing as defined in claim 1 wherein the ceramic heat insulation layer comprises $ZrO_2$ stabilized with a material selected from the group consisting of 5 to 31% CaO, 8 to 20% $Y_2O_3$, and 15 to 30% MgO.

7. A casing as defined in claim 1 wherein the top layer is selected from the group consisting of Ni-Cr-alloy, Ni-BN metal-ceramic compound, Ni-polyamid metal-plastic compound, an Ni-graphite compound.

8. A casing as defined in claim 1 including a metallic honeycomb fixed to the casing, the metallic bond coat and the ceramic heat insulation layer completely filling the cells of the honeycomb.

9. A method of making a thermal turbomachine casing having a heat insulation liner, comprising the steps of:

depositing a metallic bond coat directly on the casing wall, depositing a ceramic heat insulation layer on the bond coat, both the bond coat and ceramic layer being deposited by flame or plasma spraying, and the ceramic layer being applied before any cooling of the bond coat, and depositing an abradable coating in the form of a porous, predominantly metallic, top layer on the ceramic layer, the top layer being deposited by flame or plasma spraying before any cooling of the ceramic layer.

10. A method as defined in claim 9 including the step of peening the casing wall prior to depositing the bond coat on it.

11. A method as defined in claim 10 wherein the peening is done using $Al_2O_3$.

12. A method as defined in claim 10 wherein the casing wall is peened to a roughness height of 30 to 40 μm.

13. A method as defined in claim 9 including the step of fixing a metallic honeycomb to the casing wall prior to depositing the bond coat.

14. A method as defined in claim 13 wherein the bond coat and ceramic layer only partially fill the honeycomb cells, and the abradable coating is on the ceramic layer, the top layer being deposited by flame or plasma spraying before any cooling of the ceramic layer.

* * * * *